US006260198B1

(12) United States Patent
LoMedico

(10) Patent No.: US 6,260,198 B1
(45) Date of Patent: Jul. 17, 2001

(54) BATTING PAD

(75) Inventor: Philip R. LoMedico, Piermont, NY (US)

(73) Assignee: Pro-Hitter Corporation, Piermont, NY (US)

( * ) Notice: Subject to any disclaimer, the term of this patent is extended or adjusted under 35 U.S.C. 154(b) by 0 days.

(21) Appl. No.: 09/528,397

(22) Filed: Mar. 20, 2000

(51) Int. Cl.[7] ..... A41D 13/00
(52) U.S. Cl. ..... 2/20; 2/161.1
(58) Field of Search ..... 2/20, 21, 159, 2/16, 161.1, 267; 128/879, 880

(56) References Cited

U.S. PATENT DOCUMENTS

| | | | |
|---|---|---|---|
| D. 291,466 | * | 8/1987 | Taube . |
| 1,200,580 | | 10/1916 | Brenner . |
| 1,483,595 | | 2/1924 | Read . |
| 2,637,031 | | 5/1953 | Friedman . |
| 2,651,776 | | 9/1953 | Beatty . |
| 2,670,736 | | 3/1954 | Dunkelberger . |
| 2,797,687 | | 7/1957 | Crawford . |
| 2,999,243 | | 9/1961 | Gross et al. . |
| 4,461,043 | | 7/1984 | LoMedico . |
| 4,615,046 | * | 10/1986 | Martin . |
| 4,845,777 | * | 7/1989 | Mersinas . |
| 5,069,454 | * | 12/1991 | Frost . |
| 5,180,165 | * | 1/1993 | Frost . |
| 5,184,815 | * | 2/1993 | Maddox . |
| 5,471,682 | * | 12/1995 | Robins et al. . |
| 5,604,934 | * | 2/1997 | Willett . |
| 5,636,381 | * | 6/1997 | Brogden . |
| 5,806,091 | * | 9/1998 | McHugh . |
| 5,819,312 | * | 10/1998 | Snyder et al. . |
| 5,983,397 | | 11/1999 | Seminara . |
| 6,088,834 | | 7/2000 | Seminara . |

FOREIGN PATENT DOCUMENTS

| | | |
|---|---|---|
| 0064432 | 10/1982 | (EP) . |
| 139400 | 3/1920 | (GB) . |

* cited by examiner

*Primary Examiner*—John J. Calvert
*Assistant Examiner*—Tejash Patel
(74) *Attorney, Agent, or Firm*—Dorsey & Whitney LLP

(57) ABSTRACT

A batting pad comprising a body made from a cushioning material and having a ring portion adapted to fit over a batter's thumb and an appendage to cushion the palm area between a batter's thumb and index finger. The appendage has a thickness T at its thickest point located between the first end and the distant end, and the thickness T of the appendage is selected to optimize an angle of a bat in the batter's hand relative to a line parallel to the batter's forearm, the angle being determined by the thickness T of the appendage displacing the bat toward the tip of the batter's index finger and causing the bat to contact the palm of the batter's hand near the batter's little finger.

8 Claims, 9 Drawing Sheets

BATTING PAD

TECHNICAL FIELD

This invention relates generally to baseball accessories for aiding a batter in properly gripping and controlling a baseball or softball bat and for protecting a batter's hand from bruising or injury, including bone bruise injuries. More particularly, this invention relates to a pad worn over the thumb and between the thumb and forefinger for aiding a batter in gripping a bat.

BACKGROUND

In order for a batter to properly grasp a baseball bat, the batter should place the bat handle diagonally across an open hand, then grasp the bat primarily with the fingers, and not with the palm of the hand. The index finger and the middle finger are particularly important in grasping a bat. Grasping the bat primarily with the fingers instead of the palm not only aids the batter in controlling the bat, but it helps the batter more securely grasp the bat. A grip using primarily the fingers thus increases leverage, bat control and placement, and bat speed, thus allowing a more powerful and accurate batting stroke. If a bat is grasped deep in the palm of the hand, and if the bat rests back in the area between the thumb and index finger, the batter is not likely to have proper control of the bat, the bat may wiggle or slide between the fingers and into the palm area between the thumb and index finger, and the batter's leverage, bat control and placement, and bat speed and power may be reduced.

A strong shock or sting is often sent through a bat to a batter's hand when the batter hits a ball off the thin portion of the bat or off the end of the bat. This shock can bruise the batter's hand, particularly the area of the palm (typically near or at the base of the thumb) and index finger (typically near or at the base of the index finger). Many batters develop a bruise near or at the joint of the thumb and the hand or near or at the joint of the index finger and the hand. These bruises can interfere with a batter's game, can be painful, and can linger for an extended or permanent period of time due to periodically recurring shocks to the same area of the hand.

Many devices are known in the art to reduce the effect of the shock from hitting a baseball off the wrong spot on a bat. Some of these devices include batting gloves, which dull shocks from hitting a baseball, and pads to cushion the area between the thumb and index finger. One such pad is disclosed in U.S. Pat. No. 4,461,043. This patent discloses a cushion with a ring to fit over the thumb and an elongated portion to cushion the palm between the thumb and forefinger. FIGS. 1, 2, 5, and 7 of the present application illustrate a pad similar to that disclosed in U.S. Pat. No. 4,461,043.

As can best be seen in FIGS. 1 and 2, the pad of U.S. Pat. No. 4,461,043 consists of an elongated member 10 having a ring portion 12 containing an opening 14 to fit over a batter's thumb and a flap portion 16 extending from the ring portion 12 to cushion the area between the batter's thumb and index finger. FIG. 5 illustrates the ring portion 12 of the member 10 fitting over the batter's thumb 30. When this pad is in use, the flap portion 16 of the pad extends to the index finger 34 of the batter's hand. As shown in FIG. 1, the lower surface 18 of the member 10 is relatively flat. The upper surface 20 of the member 10 on the flap portion 16 is curved. When the batter squeezes the bat 40, as shown in FIG. 7, the lower surface 18 of the member 10 contacts the bat 40 and pushes the bat 40 away from the palm area 32 of the batter's hand and toward the batter's fingers, referred to collectively as 36.

Although the batting pad of U.S. Pat. No. 4,461,043 serves its purpose in general, it has a number of disadvantages. FIG. 5 of the present application illustrates this batting pad in the batter's hand without the bat 40 tightly gripped and FIG. 7 illustrates this batting pad with the batter gripping the bat 40. Because of the length of the member 10, particularly from the ring portion 12 to the tip 22 of the flap portion 16, the typical batter must compress and bend the flap portion 16 to tightly grip the bat 40. As can be seen in FIG. 7, the member 10 is not thick enough to push the bat 40 far enough toward the fingers 36 to allow the batter to easily grip the bat 40 with the fingers 36 instead of with the palm of the hand.

Another disadvantage of the batting pad of U.S. Pat. No. 4,461,043 is that it forces a batter to grip the bat 40 and batting pad somewhat tightly to securely grip the bat 40. As FIG. 7 illustrates, the batting pad must be compressed in length to allow the fingers 36 to wrap around the bat 40 to secure the batter's grip. FIG. 7 shows the movement of the index finger 34 and entire hand to adequately secure the bat 40 when this batting pad is used.

A need exists for a batting pad to cushion the area between the batter's thumb 30 and index finger 34 that optimizes the batter's grip of a bat, reduces the slop in a batter's grip so that the bat and pad fit snugly in the batter's hand, enables the batter to easily grip the bat with the fingers instead of with the palm of the hand, and that is properly shaped to allow the batter to easily grip the bat in a more technically favorable position with only slight movements of the batter's fingers.

SUMMARY

A batting pad comprising a body made from a cushioning material and having a ring portion adapted to fit over a batter's thumb and an appendage to cushion the palm area:between a batter's thumb and index finger. The appendage has a thickness T at its thickest point located between the first end and the distant end, and the thickness T of the appendage is selected to optimize an angle of a bat in the batter's hand relative to a line parallel to the batter's forearm, the angle being determined by the thickness T of the appendage displacing the bat toward the tip of the batter's index finger and causing the bat to contact the palm of the batter's hand near the batter's little finger. In another embodiment, the length of the appendage may be selected to aid in displacing the bat toward the tip of the batter's index finger and causing the bottom of the bat near the knob of the bat to contact the palm of the batter's hand near the batter's little finger.

Another embodiment of the invention is a batting pad comprising a body made from a cushioning material and having a ring portion adapted to fit over a batter's thumb and an appendage to cushion the palm area between a batter's thumb and index finger. In this embodiment, the appendage has a thickness T at its thickest point located between the first end and the distant end, and the thickness T of the appendage is selected to optimize an angle of the bat in the batter's hand relative to a line parallel to the batter's forearm, the angle being determined by the thickness T of the appendage displacing the bat toward the tip of the batter's index finger and causing the bat to contact the palm of the batter's hand near the batter's little finger, and such that the thickest point of the appendage contacts the palm area of the batter's hand between the proximal joint of the batter's thumb and the proximal joint of the batter's index finger. The appendage also has a length N between a first end adjacent the interior side of the ring portion and a distant end of the appendage, wherein the length N is selected such that when the batter grips the bat the appendage is substantially free of longitudinal compression and the distant end of the appendage contacts the palm area near the proximal joint of the batter's index finger.

Yet another embodiment of the invention is a device to aid a batter in gripping a bat comprising. This embodiment comprises a glove and a body made from a cushioning material and having a ring portion adapted to fit over a batter's thumb and an appendage to cushion the palm area between a batter's thumb and index finger, wherein the body fits within the glove. The appendage has a thickness T at its thickest point located between the first end and the distant end, and the thickness T of the appendage is selected such that when the batter grips a bat the appendage displaces the bat outward toward the tip of the batter's index finger and the thickest point of the appendage contacts the palm area of the batter's hand between the proximal joint of the batter's thumb and the proximal joint of the batter's index finger.

DETAILED DESCRIPTION

Figure 3:
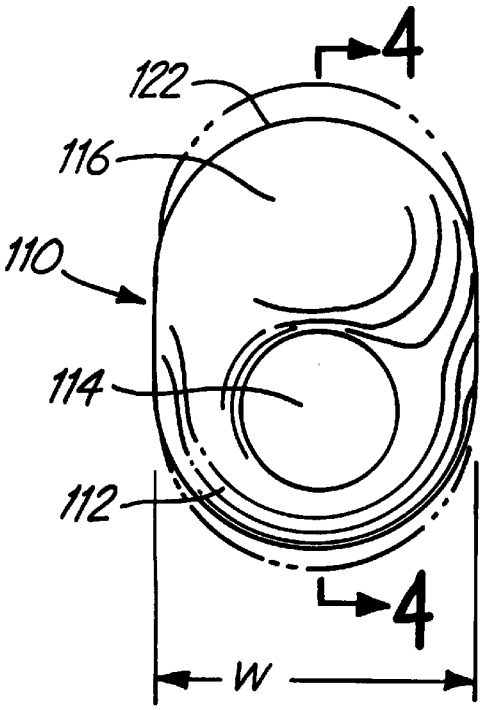
FIG. 3 is a top view of one embodiment of the invention.
Figure 4:
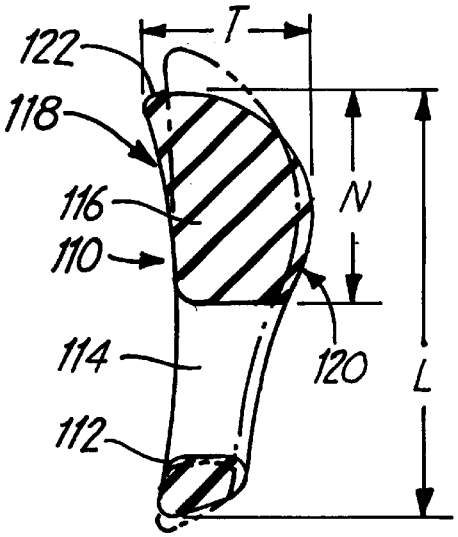
FIG. 4 is a side view of the embodiment of the invention shown in FIG. 1.
Figure 9:
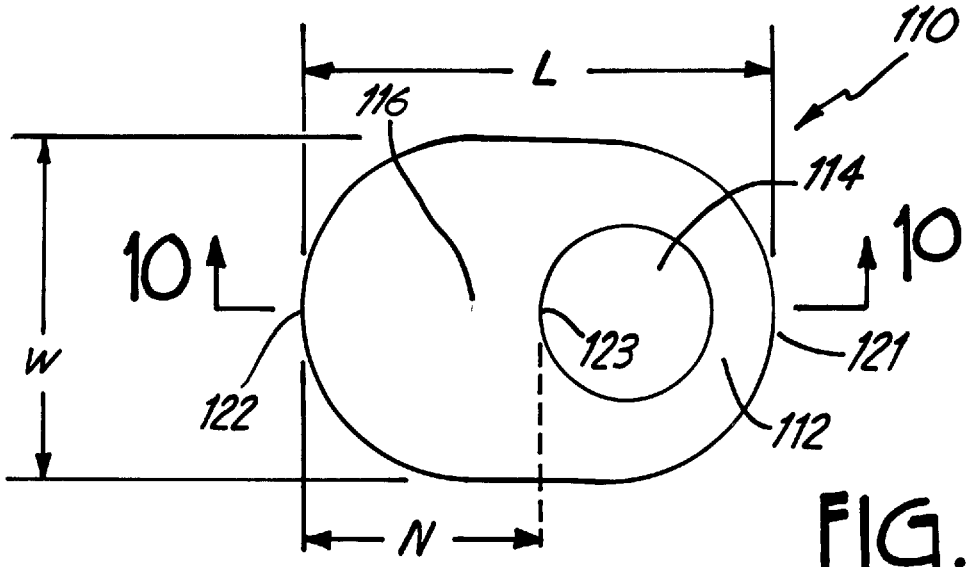
FIG. 9 is a top view of the embodiment of the invention shown in FIG. 3.
Figure 10:
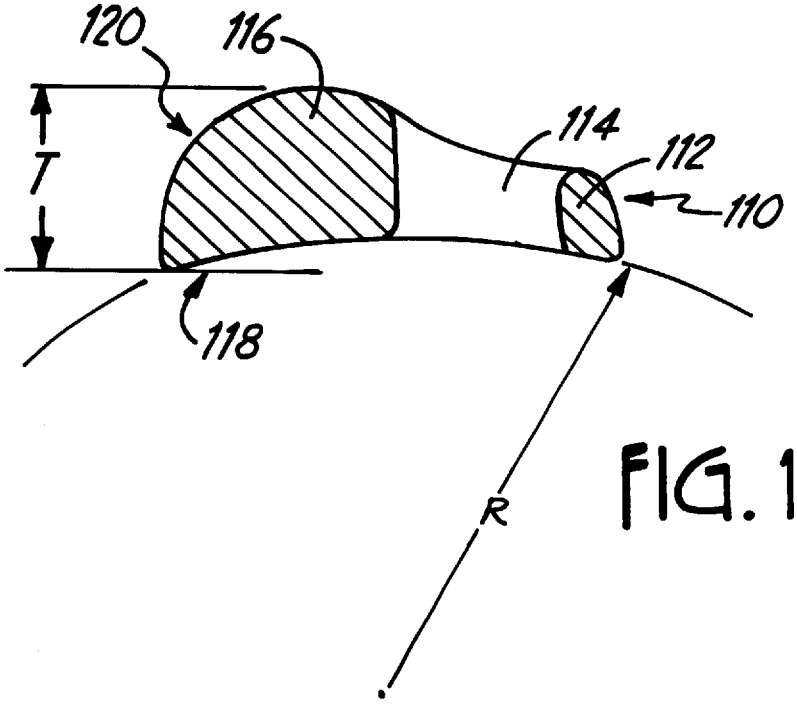
FIG. 10 is a side view of the embodiment of the invention shown in FIG. 3.

Referring to the embodiment of the invention shown in FIGS. 3 and 4, and shown in greater detail in FIGS. 9 and 10, there is shown a batting pad in general comprising a body 110 having a ring portion 112 and an appendage 116. The body 110 of the batting pad can be made from any variety of cushioning material known in the art. One such material is made by GLS Corporation and is called 6713 GLS Dynaflex. In other embodiments, any rubber material can be used to form the body 110 of the batting pad. The body 110 can be one molded piece, such as that illustrated in FIGS. 3, 4, 9, and 10, or it may be any number of pieces bonded together to form a cohesive body 110. The body 110 may also contain a hard plastic or metal skeleton running through its center (not illustrated in the figures). This skeleton can be in the shape of a circle to help form and retain the shape of the body 110 during use. In other embodiments, this metal skeleton may not be used.

The ring portion 112 of the body 110 comprises an opening 114 that is adapted to fit over the batter's thumb 30. This opening 114 can be of varying inside diameter. The opening 114 shown in the embodiment of FIG. 9 is approximately 0.875 inches in inside diameter. The body 110 may have a slightly curved lower surface 118, and the curvature of the lower surface 118 may vary. The radius of curvature of the lower surface 118 illustrated in the embodiment of FIG. 10 is approximately 4 inches. The upper surface 120 of the appendage 116 and the ring portion 112 may be curved at a greater degree than the lower surface 118. The curvature of the upper surface 120 may also vary. The upper surface 120 of the body 110 shown in the embodiment of FIG. 12 has a radius of curvature of approximately 0.8 inches.

Figure 6:
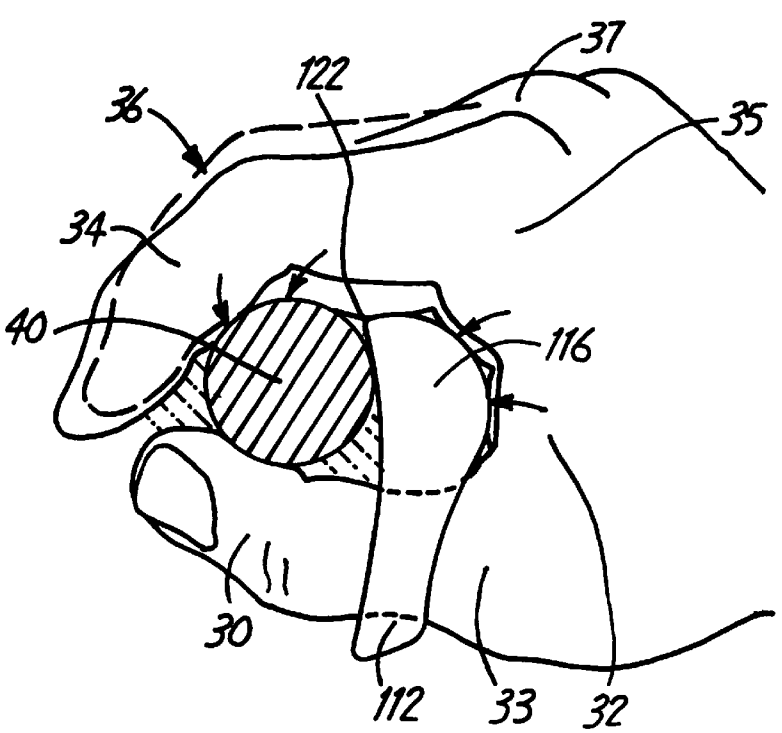
FIG. 6 is a side view of the embodiment of the invention shown in FIG. 3 being loosely held in a batter's hand along with a bat.
Figure 8:
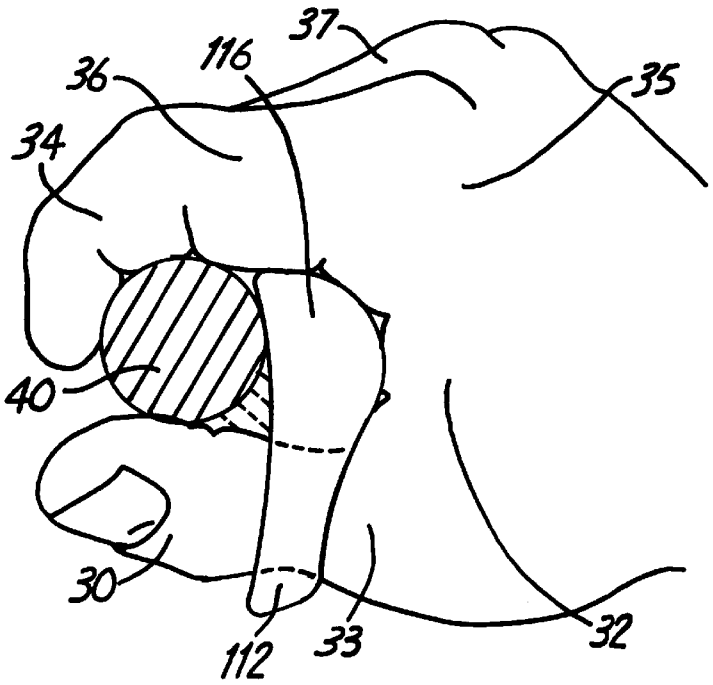
FIG. 8 is a side view of the embodiment of the invention shown in FIG. 3 along with a bat being gripped in a batter's hand.
Figure 16:
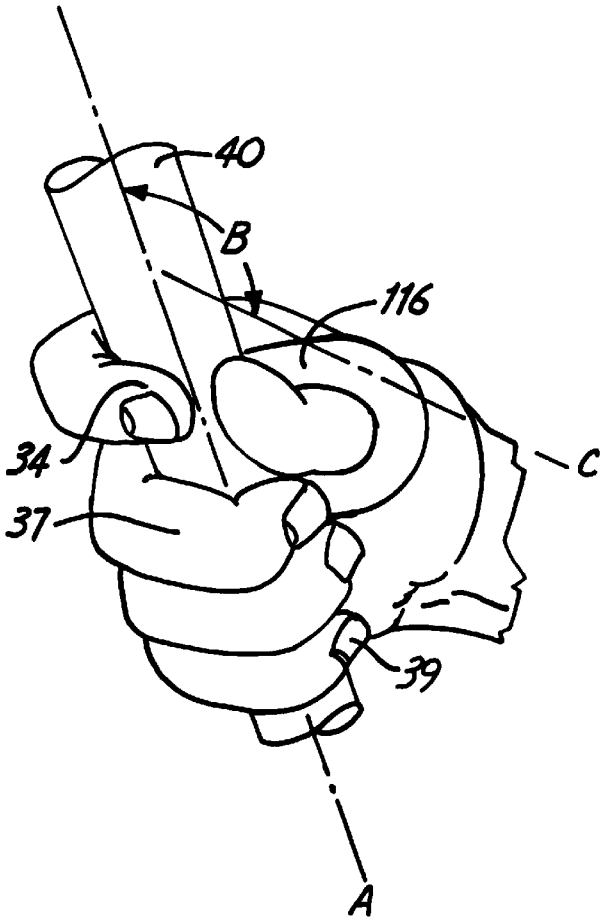
FIG. 16 is a view of the finger position of a batter's hand grasping a bat with the batter using one embodiment of the invention as a batting pad.

Referring to FIGS. 9 and 10, the body 110 has a total length L measured from an outer end 121 of the body 110 adjacent the ring portion 112 to a distant end 122 of the appendage 116. The appendage 116 has a length N measured from a first end 123 of the ring portion 112 to the distant end 122 of the appendage 116. The appendage 116 has a width W and a thickness T at its thickest point. Proper selection of the length N and thickness T are important in the performance of the batting pad. As seen in FIGS. 6, 8, and 16, the ring 114 of the batting pad is placed over the batter's thumb 30 with the appendage 116 extending toward the index finger 34. The thickness T should be selected so that when the batter grips the bat the batting pad is thick enough to force the bat well out on the batter's index finger 34. Because it is important to grip the bat with the fingers, or at least with the index and middle fingers 34, 37 and not with the palm of the hand between the thumb and index finger, the thickness T of the batting pad at its thickest location may be thick enough to displace the bat 40 far enough away from the palm of the hand onto the batter's index finger 34 so that the batter grips the bat 40 with the index finger 34 and middle finger 37 (with the bat 40 resting on the inside tip of the thumb 30) instead of with the palm. FIG. 16 shows this gripping position with one embodiment of the invention. If the length N of the appendage 116 is too great, the appendage 116 will be compressed in a longitudinal direction when the bat 40 is gripped, as seen in the view of a batting pad (such as that of U.S. Pat. No. 4,461,043) in FIG. 7. The batting pad does not readily fit in the batter's hand when the bat 40 is being gripped, because the batter is forced to apply force to compress the batting pad in a longitudinal direction in order to grasp the bat 40, as in FIG. 7. The length N of the appendage 116 of the invention, therefore, should be selected such that the appendage 116 is not compressed in length when the bat 40 is in use. The reduction of the relative length N of the appendage, and therefore the total length L of the body, allows batters with smaller hands to fit their index fingers 34 around the batting pad and bat 40; hence, a reduced length N allows these users to benefit from the invention.

As can be seen in FIGS. 6 and 8, the curved upper surface 120 of the invention contacts the palm area of the hand between the index finger 34 and the thumb 30 more readily and more smoothly than does the batting pad of U.S. Pat. No. 4,461,043; that is, the upper surface 120 lies in essentially continuous contact with the palm area. This area of the palm, referenced as 32 in the figures, is defined by the area between two joints on the batter's hand. The first joint is the metacarpal phalangeal joint 33 of the thumb 30, hereinafter referred to as the proximal joint of the thumb 30, which is the joint between the metacarpal bone and the proximal phalanx bone of the thumb 30. The second joint is the metacarpal phalangeal joint 35 of the index finger 34, hereinafter referred to as the proximal joint of the index finger 34, which is the joint between the metacarpal bone and the proximal phalanx bone of the index finger 34. The thickest point T of the appendage 116 should contact the palm area of the hand between the proximal joint 33 of the thumb 30 and the proximal joint 35 of the index finger 34. Similarly, if the curvature of the upper surface 120 of the appendage 116 is properly selected, the upper surface 120 should readily and smoothly contact the palm area 32 of the batter's hand between the proximal joint 33 of the thumb 30 and the proximal joint 35 of the index finger 34. If the length N and thickness T of the appendage 116 are properly selected, the distant end 122 of the appendage 116 should contact the palm area near the proximal joint 35 of the batter's index finger 34 so that the appendage 116 is not compressed along its length when the bat 40 is gripped.

A comparison of the present invention to the batting pad disclosed in U.S. Pat. No. 4,461,043 illustrates a number of differences between the batting pads. FIGS. 3 and 4 show the present invention in solid lines with a batting pad such as that of U.S. Pat. No. 4,461,043 in phantom lines. As can be seen in FIGS. 3 and 4, the batting pad of U.S. Pat. No. 4,461,043 is both longer and thinner. The increased thickness T and decreased length N of the present invention ensure a better fit of the batting pad in the batter's hand. The increased thickness T also increases the protective padding in the area near the joint between the thumb 30 and hand where some batters frequently bruise.

Figure 5:
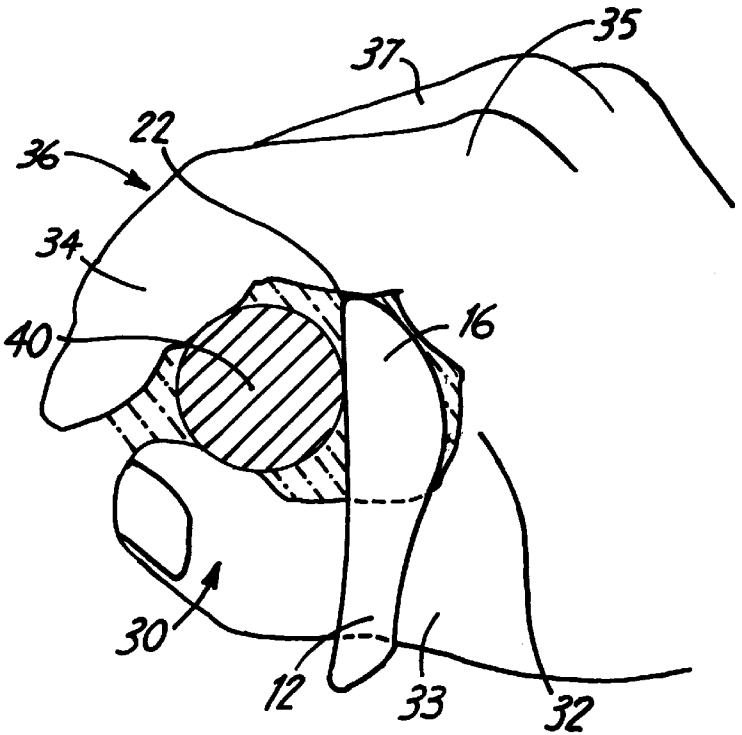
FIG. 5 is a side view of the batting pad shown in FIG. 1 along with a bat being loosely held in a batter's hand.
Figure 7:
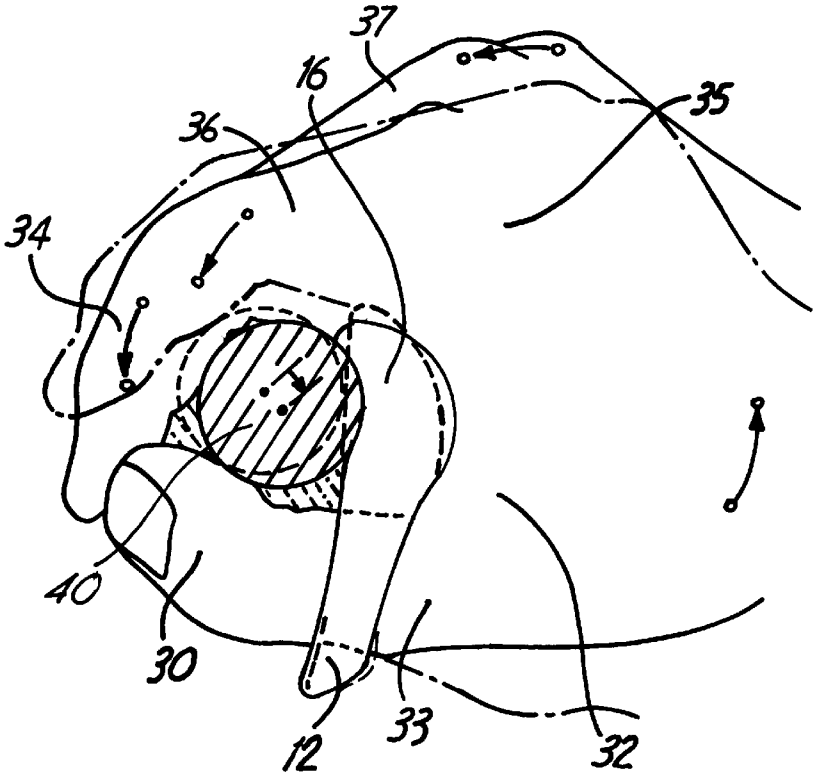
FIG. 7 is a side view of the batting pad shown in FIG. 1 along with a bat being gripped in a batter's hand.

FIGS. 5 through 8 illustrate some of the important differences between the present invention and the batting pad of U.S. Pat. No. 4,461,043. FIGS. 5 and 7 illustrate the batting pad of U.S. Pat. No. 4,461,043 in the loosely held and gripped positions respectively. FIGS. 6 and 8, similarly, illustrate the batting pad of one embodiment of the invention in the loosely held and gripped positions. A comparison between the spacing of the batting pads in FIGS. 5 and 6 in the batter's hand shows that the invention fits more snugly in the batter's hand when the bat is loosely held than does the batting pad of U.S. Pat. No. 4,461,043 when it is loosely held. Because the appendage 116 of the invention may be shorter in length N and have a greater thickness T than the batting pad of U.S. Pat. No. 4,461,043, the invention is shaped to conform to the batter's hand better than the batting pad of U.S. Pat. No. 4,461,043. The shorter length N of the appendage 116 of the invention also allows the batter's index finger 34 to contact the bat 40 with a greater proportion of the surface of this finger than does the batting pad of U.S. Pat. No. 4,461,043.

FIGS. 7 and 8 demonstrate some of the advantages of the invention over the batting pad of U.S. Pat. No. 4,461,043 when the bat 40 is in the gripped position. The shorter length N and larger thickness T of the invention allow the batter to more easily grasp the bat 40 than does the batting pad of U.S. Pat. No. 4,461,043. FIG. 7 illustrates the motion of the batter's hand and index finger 34 in grasping the bat 40 with the batting pad of U.S. Pat. No. 4,461,043 in place.

Because the invention pushes the bat 40 further onto the batter's index finger 34 and away from the batter's palm, as shown in FIG. 8, the batter need only close the fingers slightly to grasp the bat 40 as desired. Little or none of the batter's finger strength need be used to longitudinally compress the appendage 116. The greater distance of the bat 40 from the batter's palm also causes the batter to grip the bat 40 with the batter's index finger 34 and middle finger 37 (with the bat 40 supported in place by the inside tip of the thumb 30). This gripping position using one embodiment of the invention provides the batter with greater bat control, leverage, speed, and power than if no batting pad or the batting pad of U.S. Pat. No. 4,461,043 is used.

Figure 11:
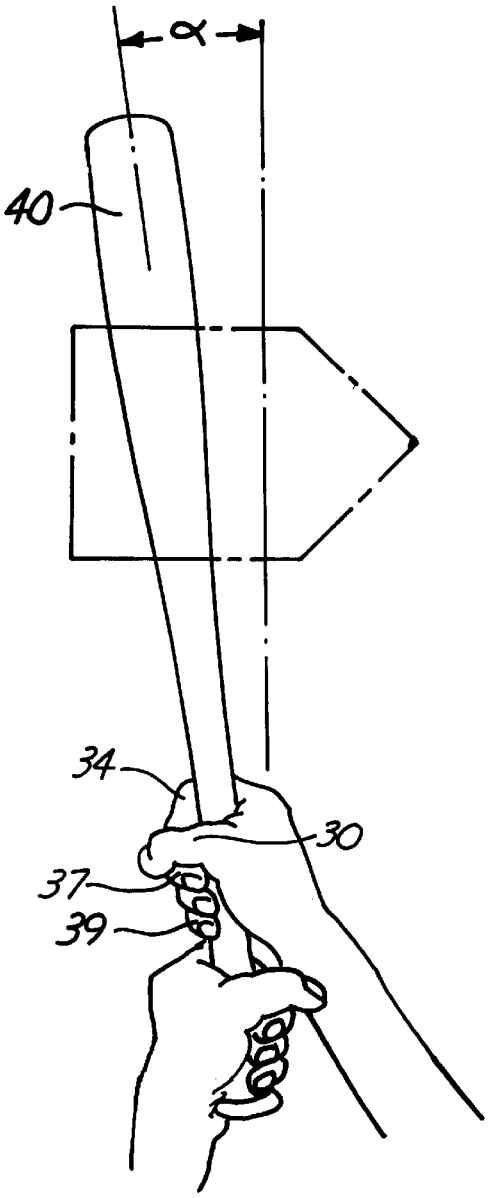
FIG. 11 is a top view above a plate of a bat in a batter's hands without the use of a batting pad.
Figure 12:
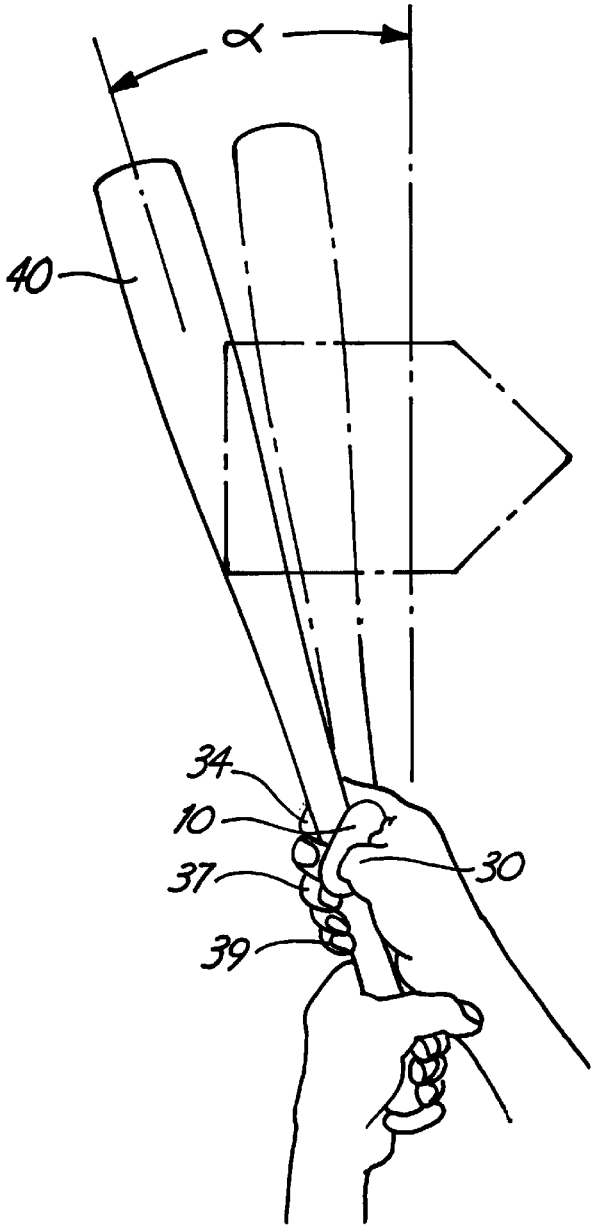
FIG. 12 is a top view above a plate of a bat in a batter's hands with the batter using a batting pad such as that disclosed in U.S. Pat. No. 4,461,043.
Figure 13:
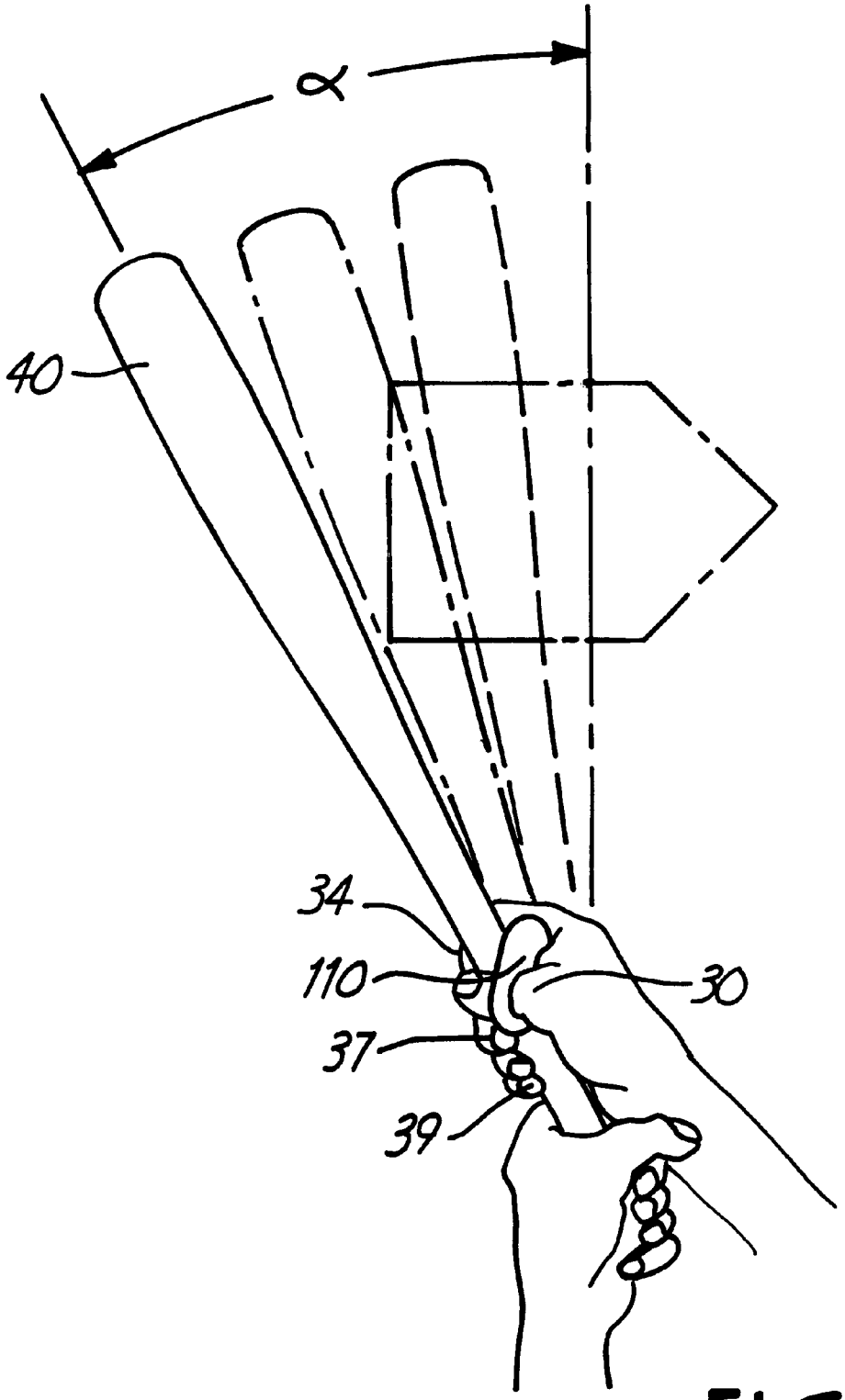
FIG. 13 is a top view above a plate of a bat in a batter's hands with the batter using one embodiment of the invention as a batting pad.

The increased thickness T of the invention also increases the angle a of the bat 40 in the batter's hand, as shown in FIGS. 11–16. FIGS. 11–13 show, from a view above home plate looking down, a bat passing through the strike zone (moving counter-clockwise as viewed in FIGS. 11–13). FIG. 11 shows the use of no batting pad to grip the bat 40, FIG. 12 shows the use of a batting pad such as that of U.S. Pat. No. 4,461,043 to grip a bat 40, and FIG. 13 illustrates an embodiment of the present invention in use with a bat 40. FIG. 12 shows in phantom lines the bat position of FIG. 11, and FIG. 13 shows in phantom lines the bat positions of FIGS. 11 and 12. In FIGS. 11–13, the angle $\alpha$ is the angle between the bat 40 and a horizontal line oriented generally perpendicular to a line between home plate and the pitcher's mound. FIGS. 11–13 show the position of the bat 40 at the same point in the batter's swing, such that the batter's wrists are in the same position in each figure. The increase of the angle $\alpha$ in FIG. 12 as compared to FIG. 11 is caused by the use of a batting pad such as that of U.S. Pat. No. 4,461,043, and the further increase of the angle $\alpha$ in FIG. 13 over the angle $\alpha$ in FIG. 12 is caused by the increased thickness T of the invention in comparison to the batting pad of U.S. Pat. No. 4,461,043. FIG. 13 also shows in phantom lines the bat position of FIG. 12 (and FIG. 11 as well), which further illustrates the difference in bat position.

Figure 14:
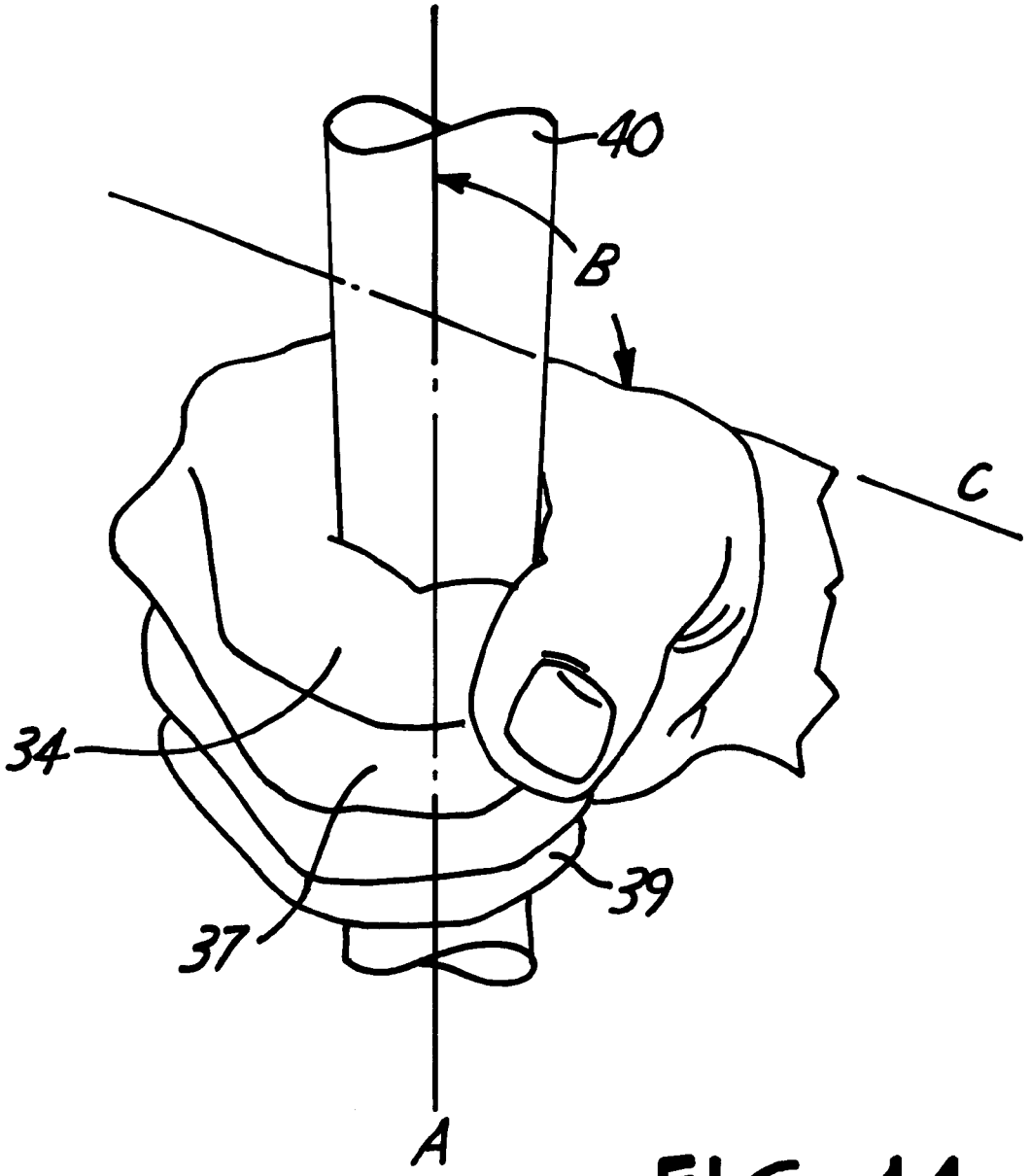
FIG. 14 is a view of the finger position of a batter's hand grasping a bat without the use of a batting pad.
Figure 15:
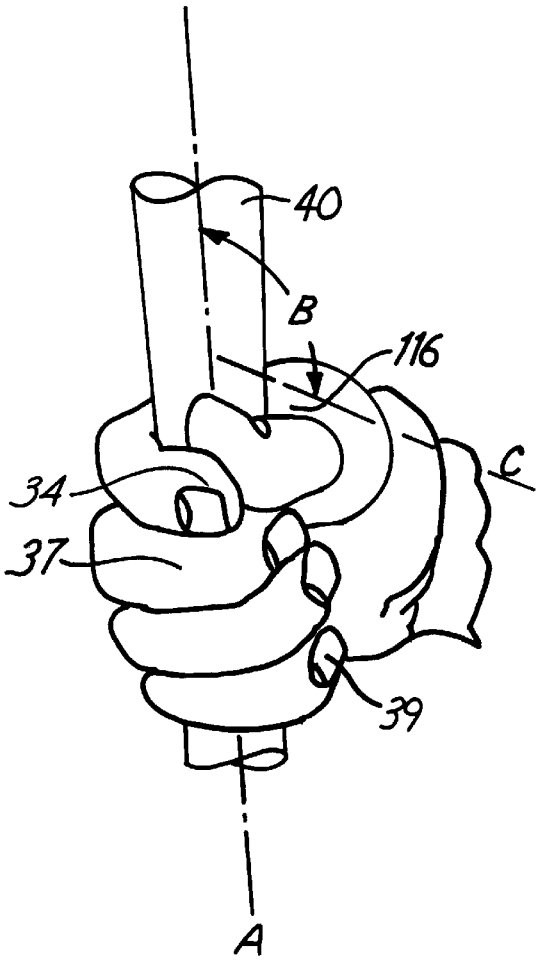
FIG. 15 is a view of the finger position of a batter's hand grasping a bat with the batter using a batting pad such as that shown in U.S. Pat. No. 4,461,043.

FIG. 16 illustrates a view of the bat 40 in the batter's hand with an embodiment of the invention in use, and FIGS. 14–15 show the same view with no batting aid and the batting aid of U.S. Pat. No. 4,461,043 respectively. The angle $\beta$ in FIG. 16 is the angle between a line parallel to the bat (denoted by A in FIGS. 14–16) and a line formed generally parallel to the batter's forearm (denoted by C in FIGS. 14–16). The increased thickness T of the invention (FIG. 16) displaces the bat 40 outward toward the tip of the batter's index finger 34 (and against the inside top of the thumb 30) with the batting pad of the invention, while at the same time causing the end of the bat 40 near the batter's little finger 39 to move toward the palm of the batter's hand. Thus, the bottom portion of the bat 40 near the knob of the bat 40 is more toward the palm of the batter's hand. The thickness T of the appendage, therefore, can be selected relative to the batter's hand size to optimize this angle $\beta$ of the bat 40 in the batter's hand. The batter should still be able to grip the bat 40 with the index and middle fingers 34, 37, but the bat 40 should be in or near the palm of the hand near the batter's little finger 39. An increased angle $\beta$ rotates the end of the bat 40 opposite the batter's hand further toward reference line C in FIG. 16. When the batter swings the bat 40 (as shown in FIG. 13), the area of the bat 40 ideal for hitting the ball as the ball approaches the front of the plate passes through the hitting zone at an earlier point in the batter's swing than if no batting pad or if the batting pad of U.S. Pat. No. 4,461,043 is used (as shown in FIGS. 14–15). At the point in the batter's swing when the batter breaks or turns over his or her wrists, therefore, the bat 40 has moved further through the hitting zone than if no batting pad or if the batting pad of U.S. Pat. No. 4,461,043 is used. The optimization of this angle β of the bat 40 in the batter's hand allows the batter to swing the bat 40 at the proper angle through the hitting zone, thus helping the batter's batting proficiency and increasing the batter's leverage and bat speed.. FIG. 15 illustrates the use of the batting pad of U.S. Pat. No. 4,461,043. Because the batting pad shown in FIG. 15 does not push the batting pad toward the tip of the index finger 34 (as does the batting pad of FIG. 16), the angle β in FIG. 15 is smaller than the angle 0 in FIG. 16, and the angle β is not optimized for batting.

FIG. 16 also illustrates the position of the bat 40 in the batter's hand relative to the batter's index finger 34 and middle finger 37 with a batting pad of the invention. FIG. 15 illustrates the same position for the batting pad of U.S. Pat. No. 4,461,043. The batting pad in FIG. 16 moves the bat nearer the tip of the index finger 34 than does the batting pad of FIG. 15, as can be seen in a comparison of these two figures. In addition, the batting pad of FIG. 16 may create a gap of approximately ¼ to ½ inch between the index finger 34 and middle finger 37. This gap, which is created by the batting pad of the invention, may create a "V" position between the index finger 34 and middle finger 37, as can be seen in FIG. 16. The bat position and grip position shown in FIG. 16 may translate into improved bat control, leverage, speed, and power for the batter.

Although the total length L, width W, and thickness T of the body 110 and length N of the appendage 116 may vary to accommodate differing hand sizes of batters, certain ratios between these dimensions may remain within set ranges in one embodiment of the invention. For instance, the total length L of the body 110, in this embodiment, should preferably be greater than the width W of the body 110. In this embodiment, a second important ratio that preferably should remain within a given range is the ratio NIT of the length N to the thickness T of the body 110. The embodiment of the invention shown in FIGS. 3–4 and 9–10 has a length N of approximately 1.2 inches and a thickness T of approximately 1 inch. The ratio NIT of the length N to the thickness T of the embodiment shown in FIGS. 3–4 and 9–10 is approximately 1.2, but this ratio can vary somewhat as well. In the embodiment of the invention shown in FIGS. 3–4 and 9–10, the ratio N/T preferably is 1.6 or less, and in another embodiment, 1.3 or less. In yet another embodiment, the ratio N/T is 1.2 or less.

Figure 1:
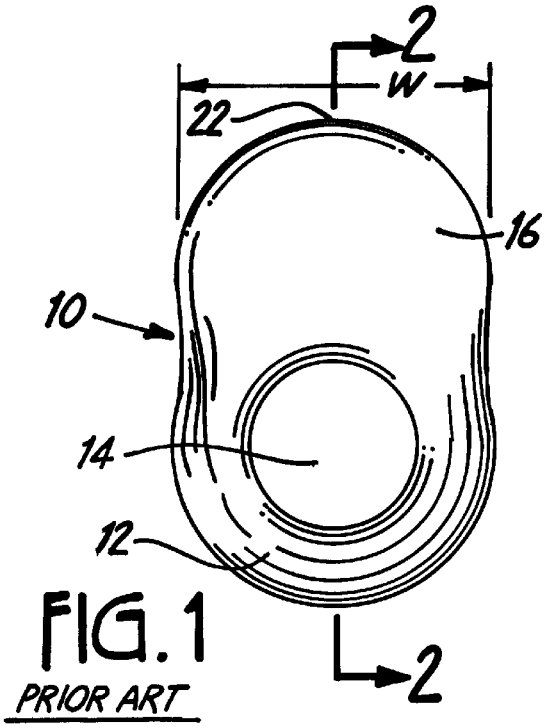
FIG. 1 PRIOR ART
FIG. 1 is a top view of a batting pad such as that disclosed in U.S. Pat. No. 4,461,043.
Figure 2:
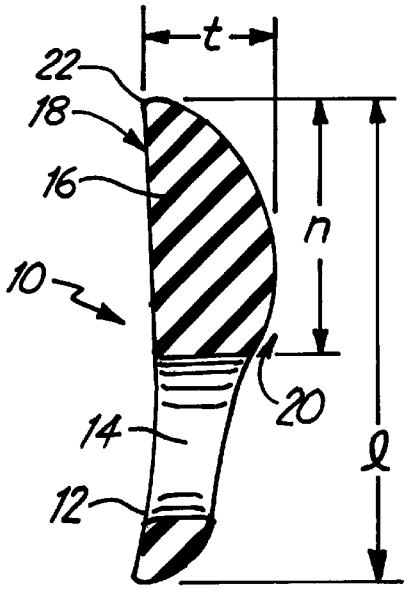
FIG. 2 PRIOR ART
FIG. 2 is side view of the batting pad shown in FIG. 1.

The total length l of a batting pad such as that of U.S. Pat. No. 4,461,043 is approximately 2.5 inches and the thickness t at its thickest point is approximately 0.75 inches (see FIGS. 1–2). The length n of the flap portion 16 is approximately 1.25 inches. The ratio n/t of the length n to the thickness t of this batting pad is therefore approximately 1.66. Because the length n of this batting pad is greater than the length N of the present invention, and because the thickness t of this batting pad is smaller than the thickness T of the invention (at least in relative terms to the other dimensions of the batting pad), the radius of curvature of the upper surface 20 of the batting pad of U.S. Pat. No. 4,461,043 is greater than that of the present invention.

Figure 17:
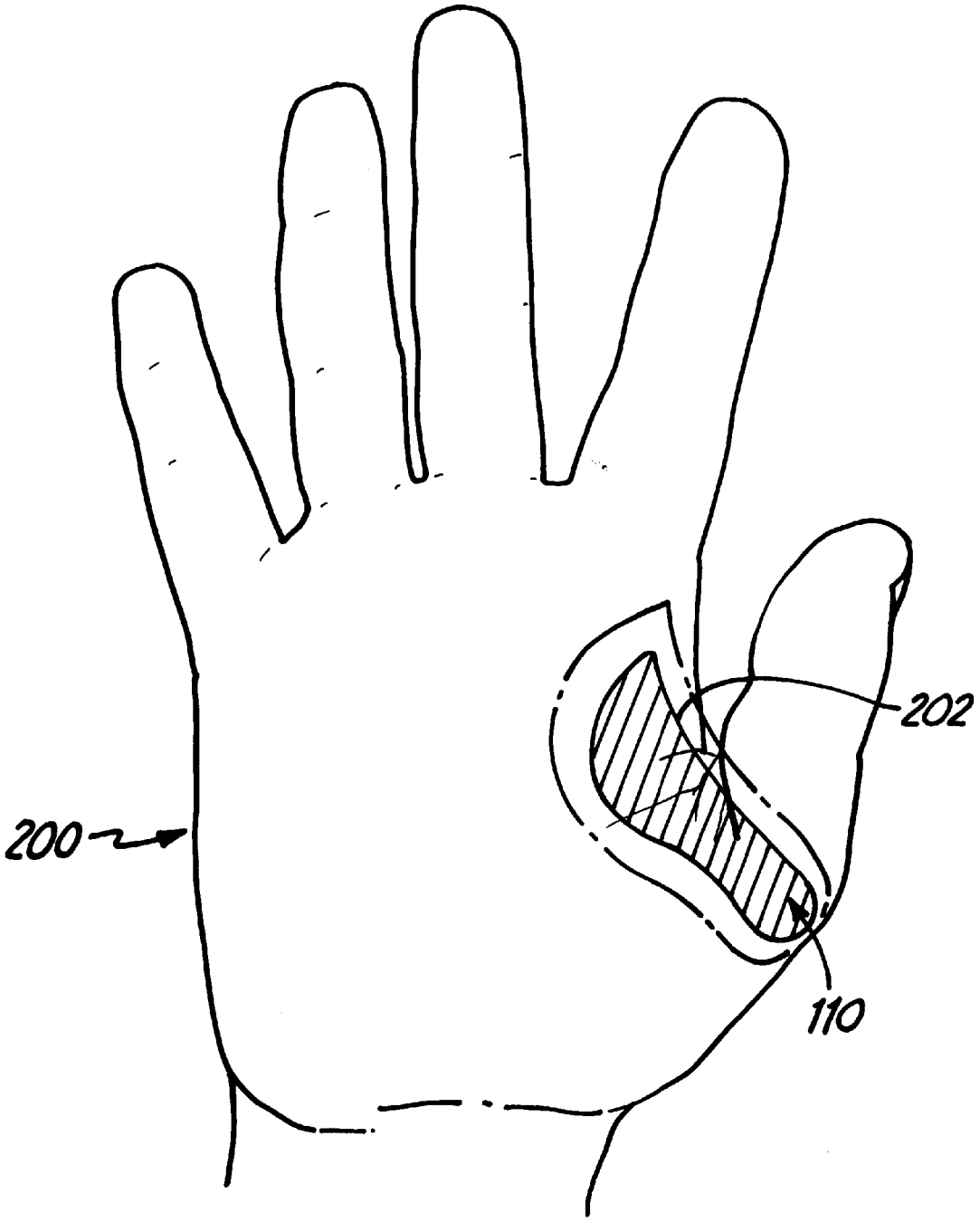
FIG. 17 is a view of a glove containing one embodiment of the batting pad of the invention.

Although the body 110 of the invention can be used in isolation as in FIGS. 6, 8, 13, and 16, it may also be used in conjunction with a batter's glove, as shown in FIG. 17. In this embodiment, the body 110 could be incorporated into a batting glove 200, such that a batter can put on the body 110 and batting glove 200 in one quick action. In this embodiment, a pocket 202 may be formed in the area of the batting glove 200 between the index finger 34 and the thumb 30 for placement of the body 110 of the invention. In other embodiments, the batting pad of the invention could be built on the outside of the glove 200 or in the inside of the glove 200.

The invention described above aids the batter in properly gripping a bat. The selection of a proper thickness T and length N of the appendage causes the batter to grip the bat with the index and middle fingers 34, 37 (and held in place by the inside portion of the thumb 30) and increases the angle of the bat in the batter's hand. The invention, therefore, improves a batter's technique in properly gripping a bat. The correct gripping technique may translate into improved bat control, leverage, speed, and power, thus aiding a batter in more consistently and powerfully hitting a ball.

While the present invention has been described with reference to several embodiments thereof, those skilled in the art will recognize various changes that may be made without departing from the spirit and scope of the claimed invention. Accordingly, this invention is not limited to what is shown in the drawings and described in the specification but only as indicated in the appended claims.

What is claimed is:

1. A batting pad comprising:

a body made from a cushioning material and having a ring portion adapted to fit over a batter's thumb and an appendage to cushion the palm area between a batter's thumb and index finger;

wherein the appendage has an upper surface and a lower surface, the upper surface contacting the palm area of the batter's hand between the proximal joint of the thumb and the proximal joint of the index finger when in use, and the lower surface contacting the bat when the batter grips the bat, wherein the upper surface has a radius of curvature of approximately 0.7 to 0.85 inches such that when the batter grips the bat the upper surface smoothly contacts the palm area of the batter's hand; and further wherein the appendage has a thickness T at its thickest point located between the first end and the distant end, the thickness T of the appendage determining an angle of a bat in the batter's hand relative to a line parallel to the batter's forearm by displacing the bat toward the tip of the batter's index finger and causing the bat to contact the palm of the batter's hand near the batter's little finger.

2. A batting pad comprising:

a body made from a cushioning material and having a ring portion adapted to fit over a batter's thumb and an appendage to cushion the palm area between a batter's thumb and index finger, the appendage having a length N between a first end adjacent the interior side of the ring portion and a distant end of the appendage configured such that when the batter grips the bat the appendage is substantially free of longitudinal compression and the distant end of the appendage contacts the palm area near the proximal joint of the batter's index finger;

wherein the appendage has a thickness T at its thickest point located between the first end and the distant end, the thickness T of the appendage determining an angle of a bat in the batter's hand relative to a line parallel to the batter's forearm by displacing the bat toward the tip of the batter's index finger and causing the bat to contact the palm of the batter's hand near the batter's little finger; and further wherein the ratio N/T of the length N of the appendage to the thickness T of the appendage is less than approximately 1.3.

3. The batting pad of claim 2 wherein the ratio N/T of the length N of the appendage to the thickness T of the appendage is less than approximately 1.2.

4. The batting pad of claim 2 wherein the ratio N/T is approximately 1.2.

5. The batting pad of claim 2 wherein the length N of the appendage is approximately 1.0 to 1.2 inches and the thickness T of the body is approximately 0.9 to 1.2 inches.

6. The batting pad of claim 2 wherein the length N of the body is approximately 1.2 inches and the thickness T of the body is approximately 0.99 inches.

7. A device to aid a batter in gripping a bat comprising:

a glove; and a body made from a cushioning material and having a ring portion adapted to fit over a batter's thumb and an appendage to cushion the palm area between a batter's thumb and index finger, wherein the body fits within the glove;

wherein the appendage has a thickness T at its thickest point located between the first end and the distant end, wherein the thickness T of the appendage displaces the bat outward toward the tip of the batter's index finger and the thickest point of the appendage contacts the palm area of the batter's hand between the proximal joint of the batter's thumb and the proximal joint of the batter's index finger; and further wherein the appendage has an upper surface and a lower surface, the upper surface contacting the palm area of the batter's hand between the proximal joint of the thumb and the proximal joint of the index finger when in use, and the lower surface contacting the bat when the batter grips the bat, the upper surface having a curvature with a radius of approximately 0.7 to 0.85 inches such that when the batter grips the bat the upper surface smoothly contacts the palm area of the batter's hand.

8. A device to aid a batter in gripping a bat comprising:

a glove; and a body made from a cushioning material and having a ring portion adapted to fit over a batter's thumb and an appendage to cushion the palm area between a batter's thumb and index finger, wherein the body fits within the glove;

wherein the appendage has a thickness T at its thickest point located between the first end and the distant end, wherein the thickness T of the appendage displaces the bat outward toward the tip of the batter's index finger and the thickest point of the appendage contacts the palm area of the batter's hand between the proximal joint of the batter's thumb and the proximal joint of the batter's index finger; and further wherein the appendage has a length N between a first end adjacent the interior side of the ring portion and a distant end of the appendage configured such that when the batter grips the bat the appendage is not substantially compressed and the distant end of the appendage contacts the palm area near the proximal joint of the batter's index finger and wherein the ratio N/T of the length N of the appendage to the thickness T of the appendage is less than approximately 1.3.

* * * * *

UNITED STATES PATENT AND TRADEMARK OFFICE

CERTIFICATE OF CORRECTION

PATENT NO. : 6,260,198 B1
DATED : July 17, 2001
INVENTOR(S) : Philip R. LoMedico It is certified that error appears in the above-identified patent and that said Letters Patent is hereby corrected as shown below:

Column 7,
Line 14, delete [angle O] and insert therefor -- angle B --

Signed and Sealed this

Twenty-sixth Day of March, 2002

*Attest:*

*Attesting Officer*

JAMES E. ROGAN
*Director of the United States Patent and Trademark Office*